United States Patent [19]

Olson

[11] 4,274,794

[45] Jun. 23, 1981

[54] LIFT TRUCK HAVING ROTATABLE PLATEN FOR HANDLING UNPALLETIZED LOADS AND METHOD FOR USING SAME

[75] Inventor: John E. Olson, Portland, Oreg.

[73] Assignee: Cascade Corporation, Portland, Oreg.

[21] Appl. No.: 88,751

[22] Filed: Oct. 29, 1979

[51] Int. Cl.[3] ..... B66F 9/14

[52] U.S. Cl. ..... 414/663; 414/661

[58] Field of Search ..... 414/661–663, 414/497, 785

[56] References Cited

U.S. PATENT DOCUMENTS

| | | | |
|---|---|---|---|
| 2,699,879 | 1/1955 | Bertram | 414/663 X |
| 2,709,017 | 5/1955 | Ulinski . | |
| 2,957,594 | 10/1960 | Brenneman | 414/785 X |
| 3,172,500 | 3/1965 | Dolphin et al. | 414/663 |
| 3,645,409 | 2/1972 | Sinclair . | |
| 3,672,526 | 6/1972 | Hansen . | |
| 3,701,446 | 10/1972 | Smith, Jr. . | |
| 3,741,418 | 6/1973 | Gamundi | 414/663 |
| 4,205,938 | 6/1980 | Olson | 414/661 X |

*Primary Examiner*—Robert W. Saifer

*Attorney, Agent, or Firm*—Chernoff & Vilhauer

[57] ABSTRACT

A mobile lift truck for handling unpalletized loads comprising a tiltable load-carrying platform projecting forwardly from the main frame of the truck rotatably mounted so as to permit rotation of the platform about a generally vertical axis of rotation between respective rotatable positions substantially 90° apart. A forwardly-facing push-pull frame having a slip sheet clamp is provided which does not rotate in unison with the platform, enabling the push frame to push loads forwardly off of the platform in both of the rotatable positions of the platform. Power-actuating circuitry is provided interconnecting the platform rotation function, push frame retraction function and slip sheet clamp release function so that the platform is prevented from rotating until the slip sheet clamp has been released and the push frame has been retracted off of the platform. Methods of application of the lift truck are also disclosed.

23 Claims, 21 Drawing Figures

FIG. 5
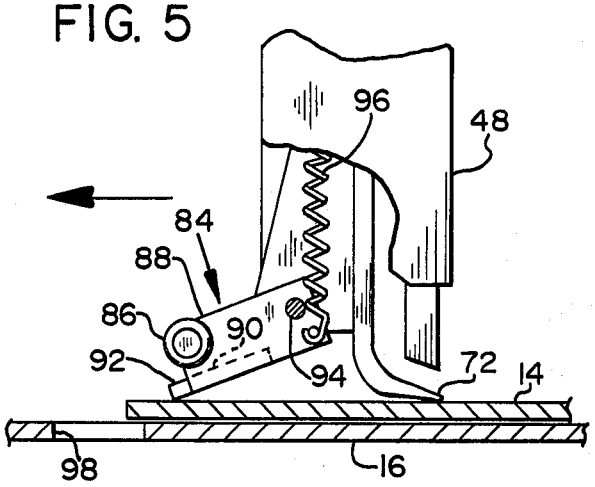
FIG. 6
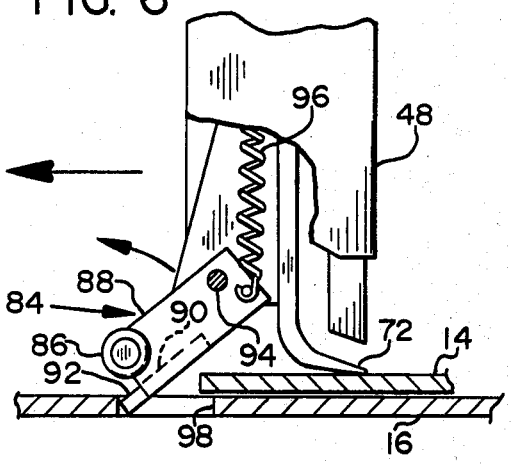
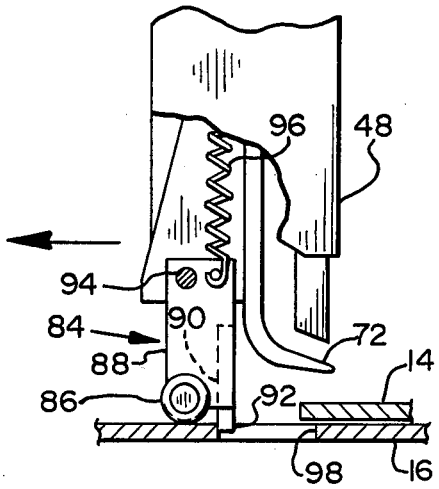
FIG. 7
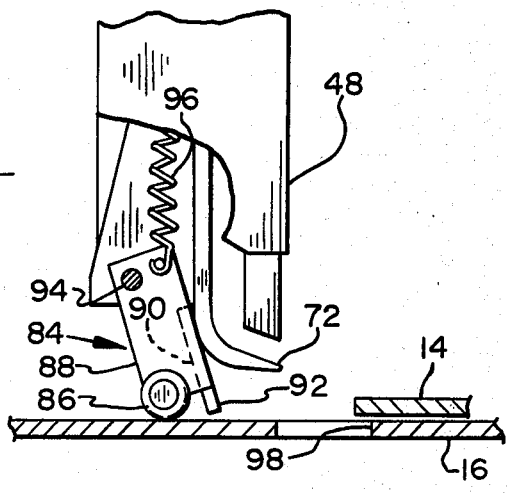
FIG. 8
FIG. 9
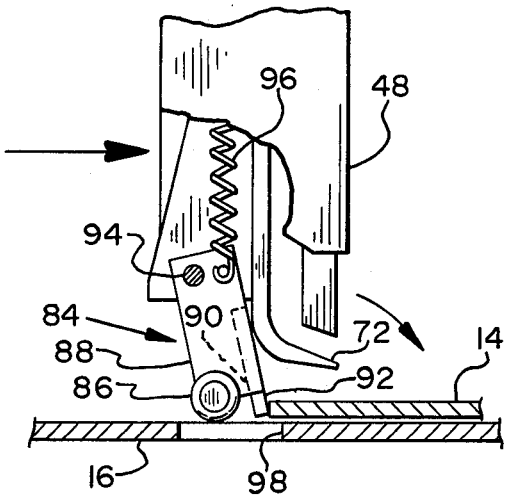

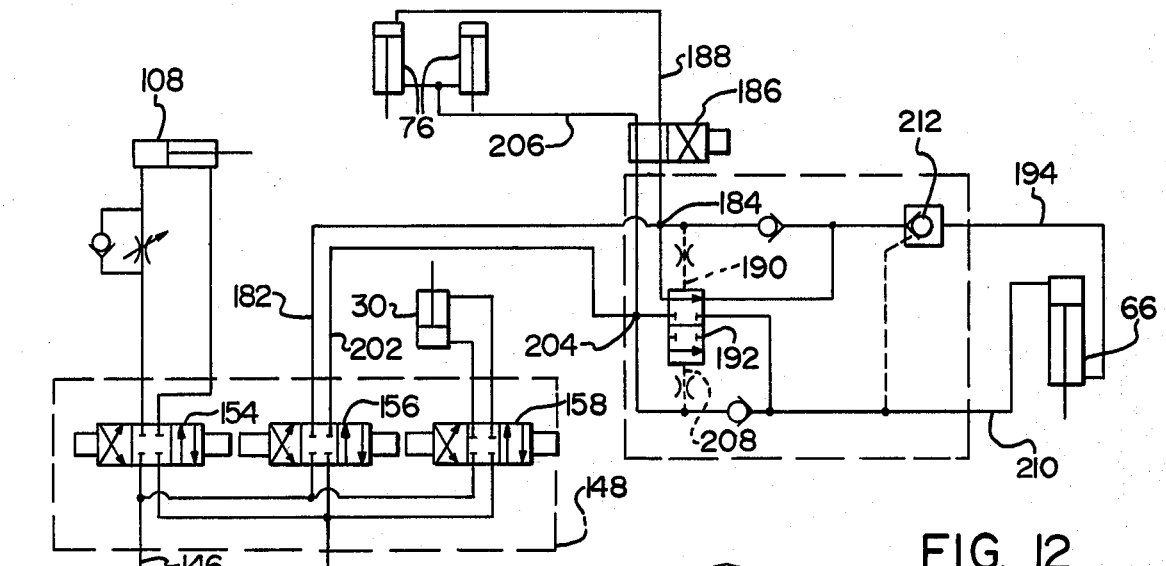
FIG. 12
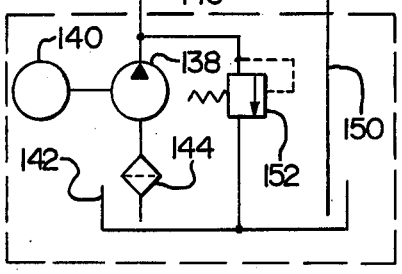
FIG. 10
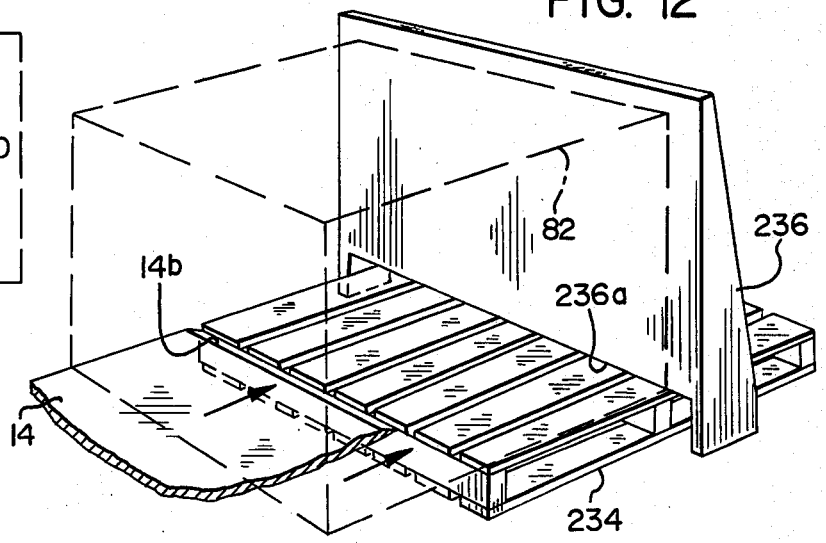
FIG. 11
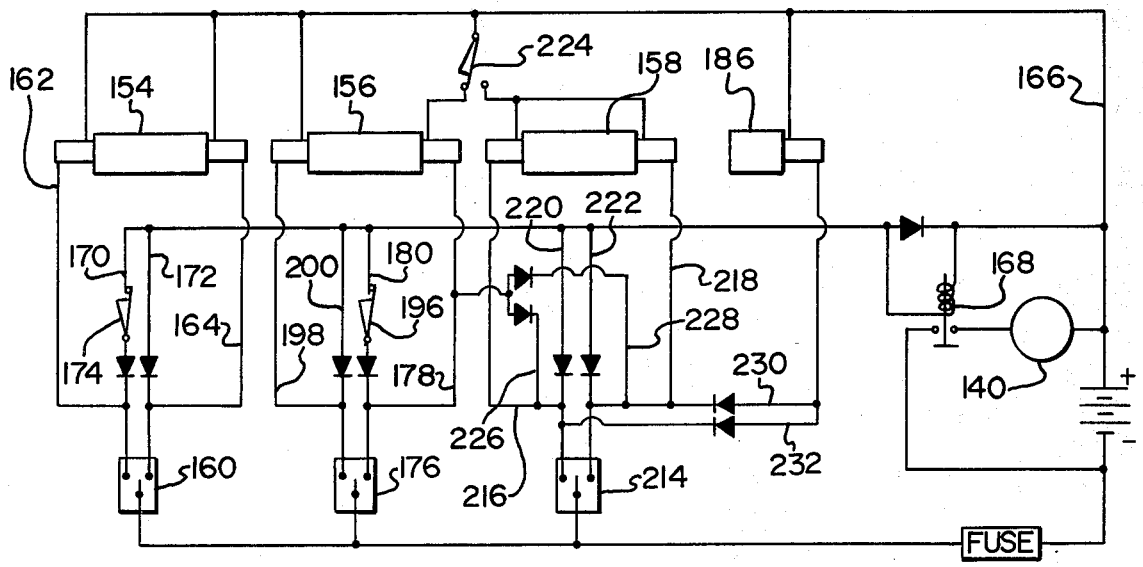

FIG. 13
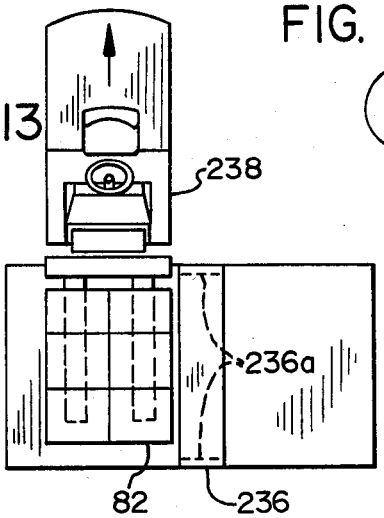
FIG. 14
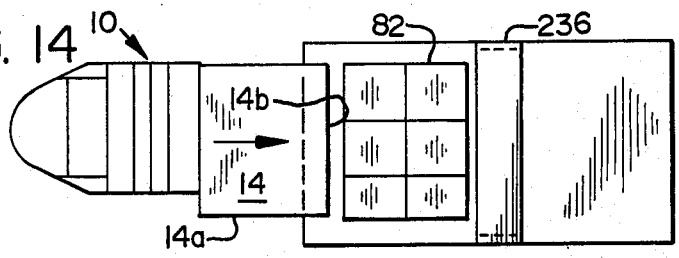
FIG. 15
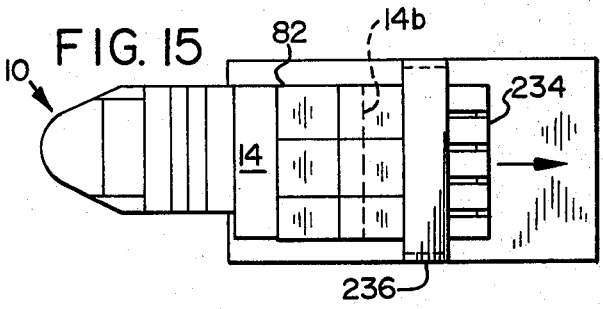
FIG. 17
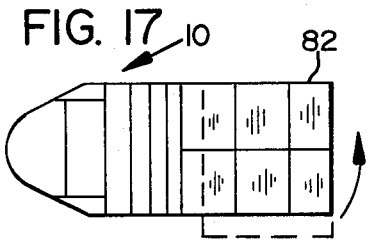
FIG. 16
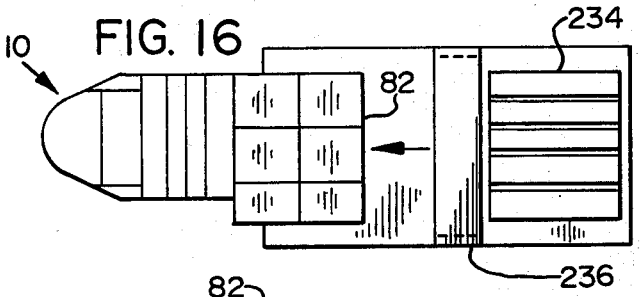
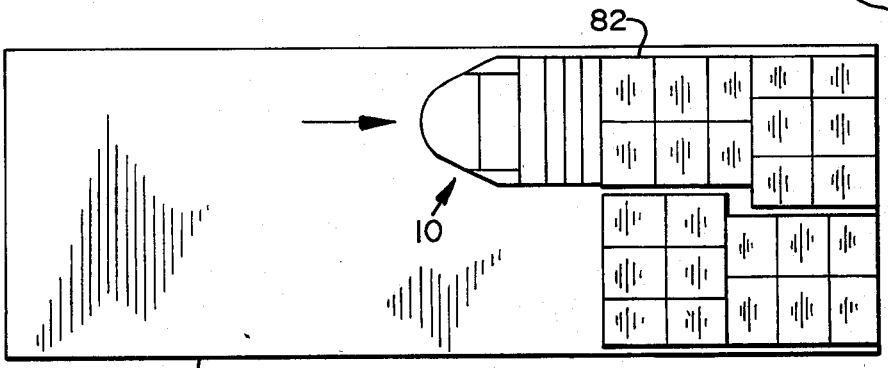
FIG. 18
FIG. 19
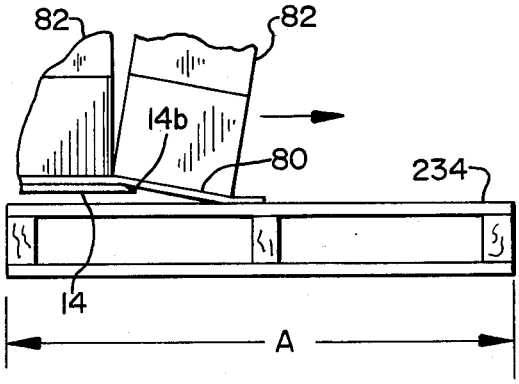
FIG. 20
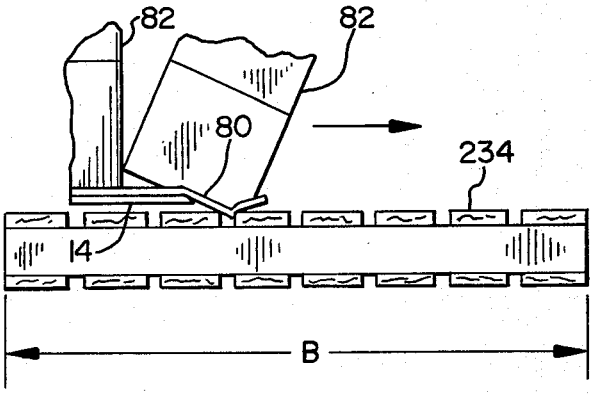

LIFT TRUCK HAVING ROTATABLE PLATEN FOR HANDLING UNPALLETIZED LOADS AND METHOD FOR USING SAME

BACKGROUND OF THE INVENTION

This invention relates to improvements in lift trucks for handling unpalletized loads. The invention is applicable both to high-lift and low-lift trucks, and in particular features a load-carrying platform which is rotatable about a generally vertical axis of rotation.

A common problem in the handling of unpalletized loads (i.e. normally those having heavy paper or cardboard slip sheets beneath them as opposed to rigid pallets) is the transfer of such loads to or from conventional rigid pallets. It has long been the practice in the materials handling industry, for maximum space utilization and handling efficiency, to arrange loads in units of generally elongate, rectangular proportion, and to support such loads upon pallets of generally corresponding elongate, rectangular proportion. A common type of pallet utilized, for example, has the shape of a rectangle with longitudinal sides measuring 48 inches and ends measuring 40 inches, with spaced parallel slats or boards providing the load-bearing surface and extending in a direction parallel with the ends of the pallet, i.e. transverse to the longitudinal dimension of the pallet. Such rigid pallets are normally utilized to support loads in warehouses and other storage facilities where available space is not severely limited and the additional space occupied by each pallet is more than compensated for by the facility which the pallets provide for manipulating the loads.

However, when a load is to be moved from a warehouse into a highway truck or trailer or other vehicle having limited cargo space, the space occupied by the rigid pallets becomes a liability and the practice has therefore developed to depalletize the loads and place them in the vehicle on slip sheets. Since the interior width of highway trucks or trailers available for placement of the loads is generally less than eight feet, it is necessary that some of the elongate loads be oriented transversely and others oriented longitudinally of the vehicle for maximum utilization of space in an arrangement known as "pinwheeling" of the loads, i.e. with the loads oriented perpendicularly to one another. This presents a problem both in the loading and unloading of the vehicle, particularly where such loading or unloading is accompanied by depalletizing and palletizing respectively of the loads. The problem arises from the fact that, in the depalletizing or palletizing of a load, it is necessary for a lift truck to move the load in a direction parallel to the direction of the load-bearing slats of the pallet (i.e. transverse to the longitudinal dimension of the load and pallet) so that the load, during depalletizing or palletizing, may slide with respect to the pallet along the longitudinal direction of the slats. Attempting to slide the load in a direction transverse to the slats results in impediments to the desired sliding motion, caused by the edge of the load catching in the longitudinal spaces between adjacent slats. Thus the lift truck must always, at some phase in the operation, orient the elongate load so as to be able to engage or deposit the load by movement (usually in the direction of travel of the truck) which is transverse to the longitudinal dimension of the load. This presents no problem where the load's orientation in the vehicle, for example, is transverse to the direction of travel of the lift truck. However, in the case of "pinwheeling" as described above, only 50% of the loads will be so oriented in the vehicle. For the remaining 50% of the loads the lift truck must at some point in the operation deposit the load in one orientation with respect to the lift truck and pick it up again in an orientation perpendicular to the original orientation. This extra step results in a substantial loss of time in depalletizing and palletizing operations and has a significant adverse effect on the overall efficiency and speed of such operations.

In the past, certain depalletizing devices of the general type exemplified by Sinclair U.S. Pat. No. 3,645,409 have been developed to aid in the transfer of loads from pallets. Some such depalletizing devices permit the lift truck to engage the depalletized load from either the side or the end of the load; however the decision must be made at the time of engaging the load, rather than later at the time of depositing the load in the vehicle, which orientation is desired. Moreover such devices are quite costly and thus their use is not particularly widespread. Furthermore such devices do not solve the aforementioned problems connected with the reverse operation of unloading and subsequent palletizing of loads.

Of course a great many lift truck load-handling attachments are known which feature load-carrying forks rotatable about a generally vertical axis. Exemplary of these are Ulinski U.S. Pat. No. 2,709,017, Hansen U.S. Pat. No. 3,672,526 and Smith, Jr. U.S. Pat. No. 3,701,446. However such prior art rotatable fork assemblies, besides being suitable generally for handling only palletized loads, are capable of rotating only between a side-engaging or depositing position and a front-engaging or depositing position, with the load in both cases having the same rotational orientation relative to the direction in which the truck moves the load during the engagement or deposit thereof. Thus, for example, if an elongate load is oriented longitudinally on the forks when the forks extend forwardly, rotating the forks of the prior art devices 90° does not permit the load to be slid onto a pallet with the load's longitudinal dimension transverse to the direction of sliding and to the slats. Rather, the rotation of any of the prior art devices to such a position that their load-handling forks extend transversely to the direction of travel of the lift truck (i.e. in their side-loading orientations), merely forces the load to be slid in a sideways direction, but still in a direction parallel with the longitudinal dimension of the load. The load, in the transverse orientation of the forks, cannot be slid in a forward direction relative to the truck, i.e. transverse to the forks and to the longitudinal dimension of the load, as would be necessary for proper palletizing because the load cannot slide transversely to the forks. Rather the load must always slide in the same direction as the direction of extension of the forks.

Accordingly it would be impossible to use such devices to extract an unpalletized load longitudinally from a vehicle forwardly of the lift truck and then deposit the load in proper orientation on a pallet without an intervening deposit and reengagement of the load. Likewise it would be impossible to depalletize a load and then deposit the load longitudinally in a vehicle forwardly of the lift truck without such intervening steps. Yet it is exactly these capabilities which are required to improve the speed and efficiency of the above-described load-handling operations.

SUMMARY OF THE PRESENT INVENTION

The primary object of the present invention is to provide a mobile lift truck, which may be either of the high-lift or low-lift type, which solves the aforementioned problems with respect to handling of elongate unpalletized loads in both transverse and longitudinal orientations by providing a load-handling assembly which is capable of engaging the load in one rotational orientation from a predetermined direction with respect to the lift truck (preferably, but not necessarily, forwardly along the direction of travel thereof), rotating the load about a generally vertical axis through an angle of 90° to a second orientation relative to the lift truck, and depositing the load in the same predetermined direction with respect to the lift truck but in the second rotational orientation.

The foregoing capability permits the lift truck, for example, to depalletize an elongate load in the conventional manner by inserting its load-carrying platform beneath the load by driving forwardly while pushing the pallet from beneath the load. Thereafter the truck may deposit the unpalletized load in either a transverse or a longitudinal orientation, as conditions may require, by pushing the load forwardly off of the load-supporting platform. Conversely, the same truck may pick up an unpalletized load in either a transverse or longitudinal orientation by pulling it onto the load-supporting platform from a position forwardly of the truck. Thereafter the truck may orient the load to a transverse position, regardless of its original orientation, and then deposit it transversely onto a pallet located forwardly of the truck by pushing the load transversely from the load-supporting platform onto the pallet in a direction parallel with the load-supporting slats of the pallet.

The foregoing capabilities are accomplished by the provision of a load-carrying platform rotatably mounted upon the lift truck for permitting rotation of the platform with respect to the lift truck about a generally vertical axis of rotation between first and second rotatable positions substantially 90° apart from each other. The load-supporting surface of the load-carrying platform extends substantially continuously in the desired, predetermined direction of load engagement and deposit (usually the forward direction of travel of the lift truck) in both rotatable positions of the platform. Thus, regardless of which rotatable orientation is selected for the platform and load, the unpalletized load may be slid easily with respect to the platform along such predetermined direction with respect to the lift truck, as opposed to rotatable fork assemblies where the forks extend continuously, and thereby allow sliding of a load, in a predetermined direction with respect to the lift truck only in a single rotatable orientation of the forks.

Together with the rotatable load-supporting platform there is provided an extensible-retractible push frame, which preferably but not necessarily has a slip sheet clamp mounted thereon for pulling as well as pushing a load, such push frame facing in the desired, predetermined direction of load engagement and deposit. The push frame does not rotate in unison with the load-supporting platform, but rather retains its predetermined direction relative to the lift truck during platform rotation so as to be able to deposit or engage the load in the predetermined direction regardless of the rotatable position of the platform.

In order to facilitate operation, and prevent inadvertent mishaps, electrohydraulic circuitry is provided in combination with power actuators for the platform rotator, slip sheet clamp and push frame retraction-extension mechanism, which prevents rotation of the load-carrying platform unless the slip sheet clamp is in its released position and the push frame is retracted off of the platform. Such circuitry prevents inconsistent functioning of these various components and, furthermore, preferably provides automatic sequential functioning of these components in response to actuation of the platform rotation mechanism.

A further salient feature of the invention is the location of the vertical axis of rotation of the load-carrying platform at a position between the center of the area of the load-supporting surface of the platform and one of its edges. The primary purpose of this offset location of the axis of rotation is to minimize the rear turning radius of the load-supporting surface, which is preferably rectangular, without requiring excessive forward placement of the load-supporting surface which would adversely affect the forward tipping stability of the lift truck. In addition, since the load-carrying platform is preferably elongate, the offset permits the axis of rotation to be positioned equidistant from the two mutually-perpendicular load-engaging edges of the platform, such that such edges extend the same distance from the lift truck in both rotational positions of the platform. It is noteworthy that the position of the axis of rotation does not, however, have an extreme offset such as to one edge of the load-supporting platform, since an excessive offset would tend to shift the center of mass of the load too far from its original position upon rotation of the load, thereby adversely affecting truck stability, and would also exert excessive centrifugal force on the load during rotation tending to slide it off of the load-supporting surface.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIGS. 5–9 are detail views showing sequential retraction and extension of the push-pull frame relative to the rotating load-carrying platform.

FIG. 10 is a schematic diagram of the hydraulic power circuitry for the lift truck of FIG. 1.

FIG. 11 is a schematic diagram of the electric control circuitry for actuating the hydraulic circuitry of FIG. 10.

FIG. 12 is a perspective view showing the preferred manner of depalletizing a load using the apparatus of the present invention.

FIGS. 13–18 are simplified top views showing sequence of operation of depalletizing and loading a load into a highway trailer utilizing the apparatus of the present invention.

FIG. 19 is a partial side view showing the manner of palletizing a load utilizing the apparatus of the present invention.

FIG. 20 is an exemplary partial side view showing the type of problem which may be encountered in attempting to palletize a load utilizing prior art equipment.

DESCRIPTION OF THE PREFERRED EMBODIMENT

STRUCTURE

Figure 1:
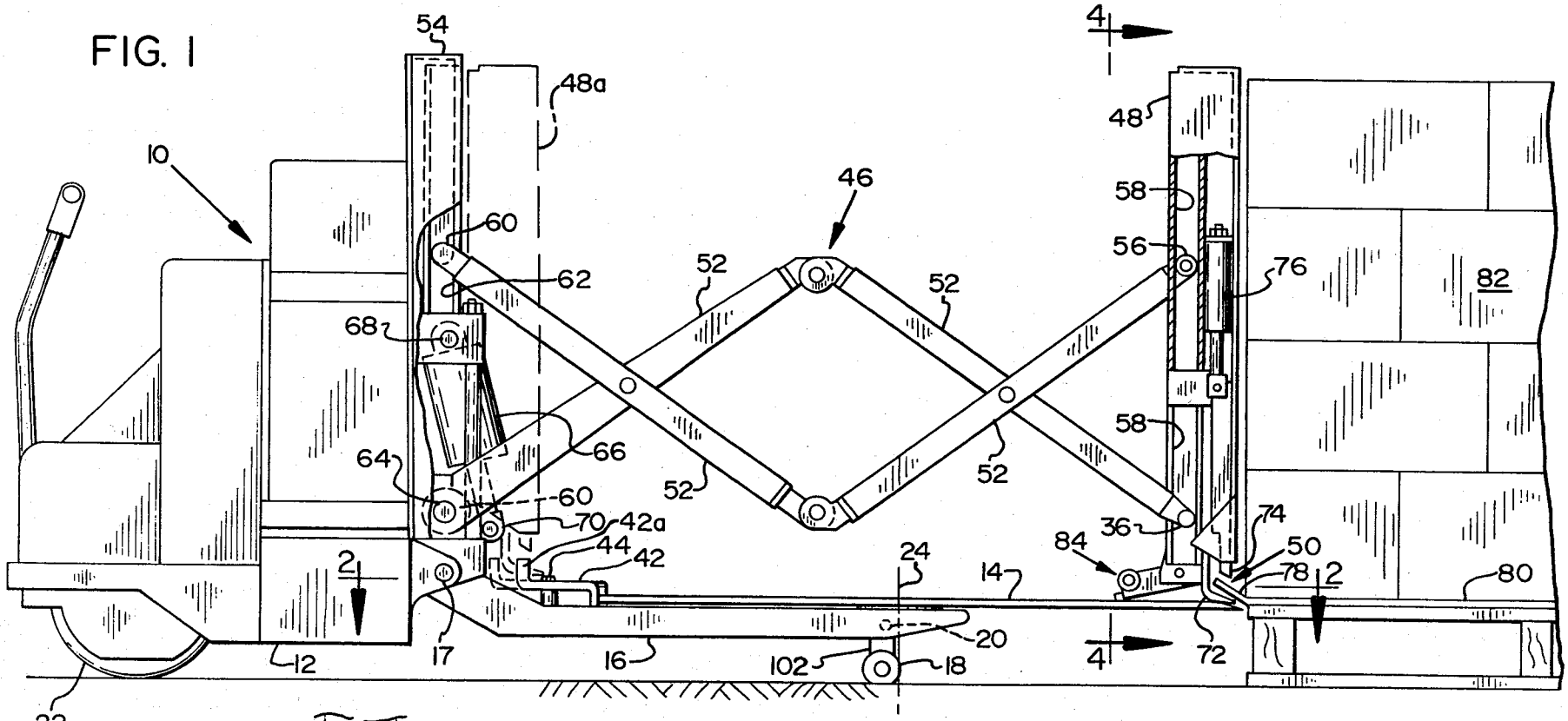
FIG. 1 is a side view of an exemplary low-lift truck equipped with a rotatable load-carrying platform and push-pull assembly in accordance with the present invention.

FIG. 1 depicts a low-lift truck, indicated generally as 10, having a main frame 12 which has a load-carrying platform 14 projecting forwardly therefrom. The main frame 12 includes a load-tilting frame 16 hingedly connected to the remainder of the main frame by a horizontal shaft structure such as 17 to permit the tilting frame 16 to articulate with respect to the remainder of the main frame. The tilting frame 16 operates by means of a hydraulic power mechanism, to be explained hereafter, to selectively tilt the load-carrying platform downwardly by rearward pivotal movement of the supporting wheels 18 (only one of which is shown) about a respective pivot shaft 20 or, alternatively, raise the platform 14 to a substantially horizontal position by forward pivoting of the wheels 18 to the position shown in FIG. 1. It should be understood, however, that the tilting function is not part of the present invention and in fact could be carried out in a completely different manner as, for example if the load-carrying platform 14 were mounted on a high-lift truck, by tilting of the lift truck mast forwardly and rearwardly in a conventional manner.

A linkage, to be explained hereafter, interacting between the tilting frame 16 and main frame 12 maintains the main frame 12 in a constant relationship with respect to the ground during tilting movement of the frame 16 by positively variably controlling the angle of articulation between frame 16 and main frame 12. A drive-steer wheel 22 propels the truck 10 forwardly along a direction of travel.

Figure 3:
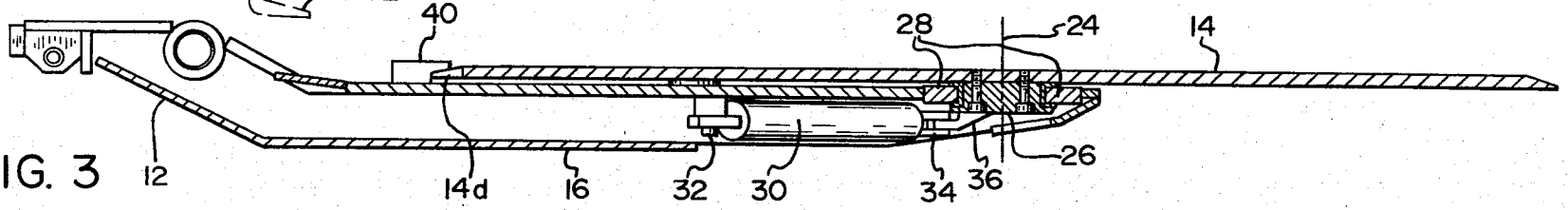
FIG. 3 is a sectional view of the load-carrying platform and supporting structure taken along line 3—3 of FIG. 2.
Figure 2:
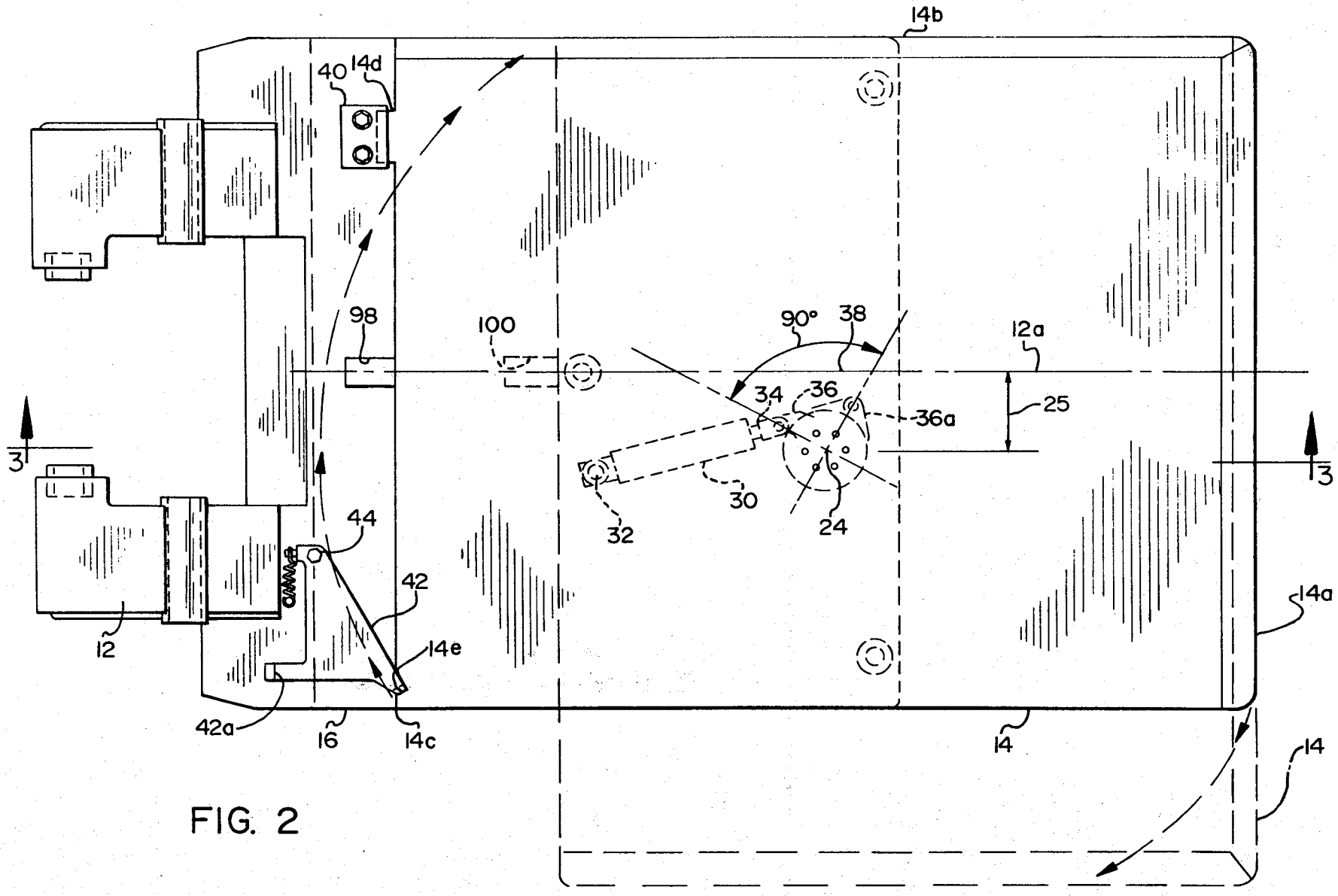
FIG. 2 is an enlarged top view of the rotatable load-carrying platform taken along line 2—2 of FIG. 1.

As best seen in FIGS. 2 and 3, the elongate rectangular load-carrying platform 14 is rotatably mounted upon the tilting frame portion 16 of the main frame 12 for rotation of the platform 14 about a generally vertical axis of rotation 24 between one rotatable position shown in solid lines in FIG. 2 oriented longitudinally with respect to the direction of travel of the main frame 12 (which direction is parallel to the longitudinal centerline 12*a* of the main frame), and another rotatable position substantially 90° apart therefrom as shown in phantom in FIG. 2 oriented transversely with respect to the direction of travel of the main frame. The pivotal mounting of the platform 14 is accomplished by means of a hub 26 rotatably journaled in bearings 28 which are mounted in the tilting frame 16, both the bearings and hub being located below the load-carrying platform 14. While it is within the scope of the present invention that rotation of the platform 14 could be accomplished externally, i.e. rotating the load and platform 14 manually or by some other external force, preferably such rotation is accomplished by means of a selectively-actuated, double-acting hydraulic ram 30 connected by a pivotal connection 32 to the tilting frame 16 and pivotally connected by a clevis 34 to a crank arm 36 fixedly protruding from the hub 26. Thus, upon extension of the ram 30, the crank arm 36 is rotated clockwise through an angle of 90° to a position 36*a* as shown in FIG. 2, thereby rotating the platform 14 from its aforementioned longitudinal rotatable position to its transverse rotatable position. As will be appreciated by those skilled in the art, a pair of cylinder and piston assemblies 30 could alternatively be utilized in tandem on a pair of crank arms 36 to rotate the platform 14 if increased rotational force and/or slower rotational speed were required without a corresponding increase in cylinder diameter because of space limitations.

The upwardly-facing load-supporting surface of the load-carrying platform 14 is of generally rectangular, smooth, flat configuration extending both substantially continuously across the longitudinal centerline 12*a* of the main frame 12 and substantially continuously in the direction of travel of the main frame in both the longitudinal and transverse rotatable positions of the platform 14. These features of the platform 14, as depicted in FIG. 2, ensure that the side stability of the truck will be maintained in both rotatable positions of the platform 14, and especially ensure that an unpalletized load will be slidable with equal facility along the direction of travel of the lift truck across the top of the platform 14 in both the longitudinal and transverse rotatable positions of the platform.

The shape of the load-carrying platform 14 is preferably rectangular and oblong, so as to correspond approximately with normal oblong load proportions, with a pair of mutually-perpendicular load-engaging edges 14*a* and 14*b* respectively each adapted to face forwardly in a respective one of the aforementioned rotatable positions of the platform. At least one of the edges 14*a* and 14*b*, and preferably both, are beveled as best seen in FIGS. 1 and 3 to facilitate engagement of unpalletized loads in a manner to be described more fully hereafter.

As illustrated in FIG. 2, the axis of rotation 24 of the platform 14 is offset by the distance 25 from the center of the area, depicted by the point 38, of the rectangular platform 14 so as to lie between the center of area and an edge of the platform 14. This offset location of the axis of rotation 24 diminishes by a significant amount the rearward turning radius of the corner 14*c* of the platform 14 from that which would otherwise exist if the axis of rotation 24 were at the center of area 38. This in turn permits the platform 14 to be positioned more rearwardly with respect to the main frame 12 than would otherwise be the case without the offset axis of rotation, which permits loads to be positioned more rearwardly with respect to the main frame so as to maximize the forward tipping stability of the truck which is counterbalanced about the fulcrum of the wheels 18. It should be noted that, despite the offset position of the axis of rotation 24, the axis is still positioned well within the area of the rectangular supporting surface so that the center of gravity of the load will not be displaced so far from the axis of rotation as to cause an undesired degree of centrifugal force tending to displace the load during rotation. Preferably the axis of rotation 24 is offset so as to be substantially equidistant from the edges 14*a* and 14*b* so that each of such edges protrudes substantially the same distance forward of the lift truck in the respective rotatable positions of the platform for consistency of operation in conjunction with the tilting and push-pull assemblies to be described hereafter. Also preferably the axis of rotation 24 is offset not only from the center of area 38, but also transversely from the longitudinal centerline 12*a* of the main frame by substantially the same offset distance 25. This enables the platform 14 to be centered with respect to the longitudinal centerline 12*a* in at least one of its two rotatable positions for maximized stability and visibility while the load is being transported by the lift truck from one location to another. This transversely-centered, transporting position of the platform 14 is indicated in solid lines in FIG. 2 as the longitudinal orientation of the platform 14.

In order to prevent dynamic forces, jolts, etc. from tending to rotate the platform 14 when longitudinally oriented in the traveling position, mechanical stops are provided to lock the platform in such position. To prevent rotation in a counterclockwise direction as shown in FIG. 2, a lug 14*d* protruding rearwardly from the platform 14 abuts against a stop 40 mounted on the main frame. To prevent rotation in the clockwise direction as shown in FIG. 2, a spring-biased latch 42 pivotal about a point 44 locks into a notch 14*e* on the rear edge of the platform 14. Release of the latch 42 to permit rotation of the platform 14 in a clockwise direction to its transverse rotatable position as shown in phantom in FIG. 2 will be explained hereafter.

It should be mentioned that it may be desirable, depending upon the habits of the lift truck operator, to reverse the direction of rotation employed to move the platform 14 from its longitudinal rotatable orientation to its transverse orientation. Such reversal of direction of rotation would also require reversal of the positions of the axis of rotation 24, ram 30, stop 40 and latch 42 to the opposite side of the longitudinal centerline 12*a* of the lift trunk such that the arrangement would constitute a mirror image of that shown in FIG. 2. The reversal of direction of rotation would be preferable for operators who are accustomed to aligning loads visually along the left-hand side of the lift truck so that the edge of the platform 14 along which the operator aligns the load is the edge which rotates rearwardly into a position adjacent the main frame when the platform is rotated from its longitudinal orientation to its transverse orientation. Otherwise, if the load is not aligned with, but rather is permitted to overhang, the edge of the platform which rotates rearwardly adjacent to the main frame 12, the overhanging load will contact the main frame 12 and interfere with completion of the rotational movement.

The lift truck 10 is provided with a push-pull assembly indicated generally as 46 in FIG. 1. An upright push frame 48, having a load-pulling capability by virtue of the provision of a slip sheet clamp indicated generally as 50 mounted on the push frame at the bottom thereof, is connected to the main frame 12 by a pair of laterally-spaced, selectively extensible and retractable pantographic linkages comprising pivotally interconnected arms 52. The arms 52 extend rearwardly from the push frame 48 to a rear mounting frame 54 fixedly mounted on the main frame 12 so as to be immovable with respect thereto. The pantographic linkages have laterally-spaced pairs of front couplings 56 pivotally and slidably mounted within rectilinear channels 58 connected to the rear side of the push frame 48 such that the push frame may move freely in a vertical, rectilinear direction with respect to the arms 52. Pairs of laterally-spaced rear couplings 60 interconnect the arms 52 to the rear mounting frame 54. The upper rear couplings are pivotally and slidably mounted in vertical rectilinear channels 62 connected to the front of the rear mounting frame 54, while the lower rear couplings are pivotally, but not slidably, connected to the rear mounting frame by fixed attachment to a shaft 64 pivotally mounted on the front of the rear mounting frame 54. A ram 66 has its cylinder portion pivotally connected to the rear mounting frame 54 by means of a shaft 68, and its piston rod pivotally connected to a crank 70 fixed to the shaft 64. Extension and retraction of the ram 66 respectively extends and retracts the pantographic linkage and push frame 48 by rotating the shaft 64 and thereby rotating the pair of arms 52 fixedly connected thereto. In the low-lift truck depicted, the rear mounting frame 54, because of its fixed attachment to the main frame 12, does not tilt in unison with the load-carrying platform 14 but rather maintains a constant, vertical attitude with respect to the ground. However the push frame 48 is capable of vertical movement with respect to the rear mounting frame 54 due to the sliding connections between the linkage front couplings 56 and the push frame 48. Thus the push frame may move between the lowered position and a raised position in response to the tilting movement of the load-carrying platform 14.

The push frame 48 is equipped with the aforementioned slip sheet clamp 50 which comprises a lower jaw 72 and an upper jaw 74 movable vertically with respect to the push frame 48 in response to the extension or retraction of a pair of hydraulic rams 76 mounted on the push frame 48. Such clamp operates by slipping the fixed jaw 72 beneath the protruding edge 78 (FIG. 1) of a slip sheet 80 positioned beneath a load 82. Once the edge 78 is between the jaws 72 and 74, the rams 76 may be extended to clamp the movable jaw 74 against the fixed jaw 72. The push frame 48 is vertically supported by the abutment between the load-carrying platform 14 and the fixed jaw 72 such that the push frame 48 moves vertically in unison in response to the tilting movement of the load-carrying platform 14 without change in angular attitude of the push frame. This constant angular attitude of the push frame 48 in all tiltable positions of the load-carrying platform 14 ensures that the push frame is always aligned vertically with the side of a load such as 82.

Figure 4:
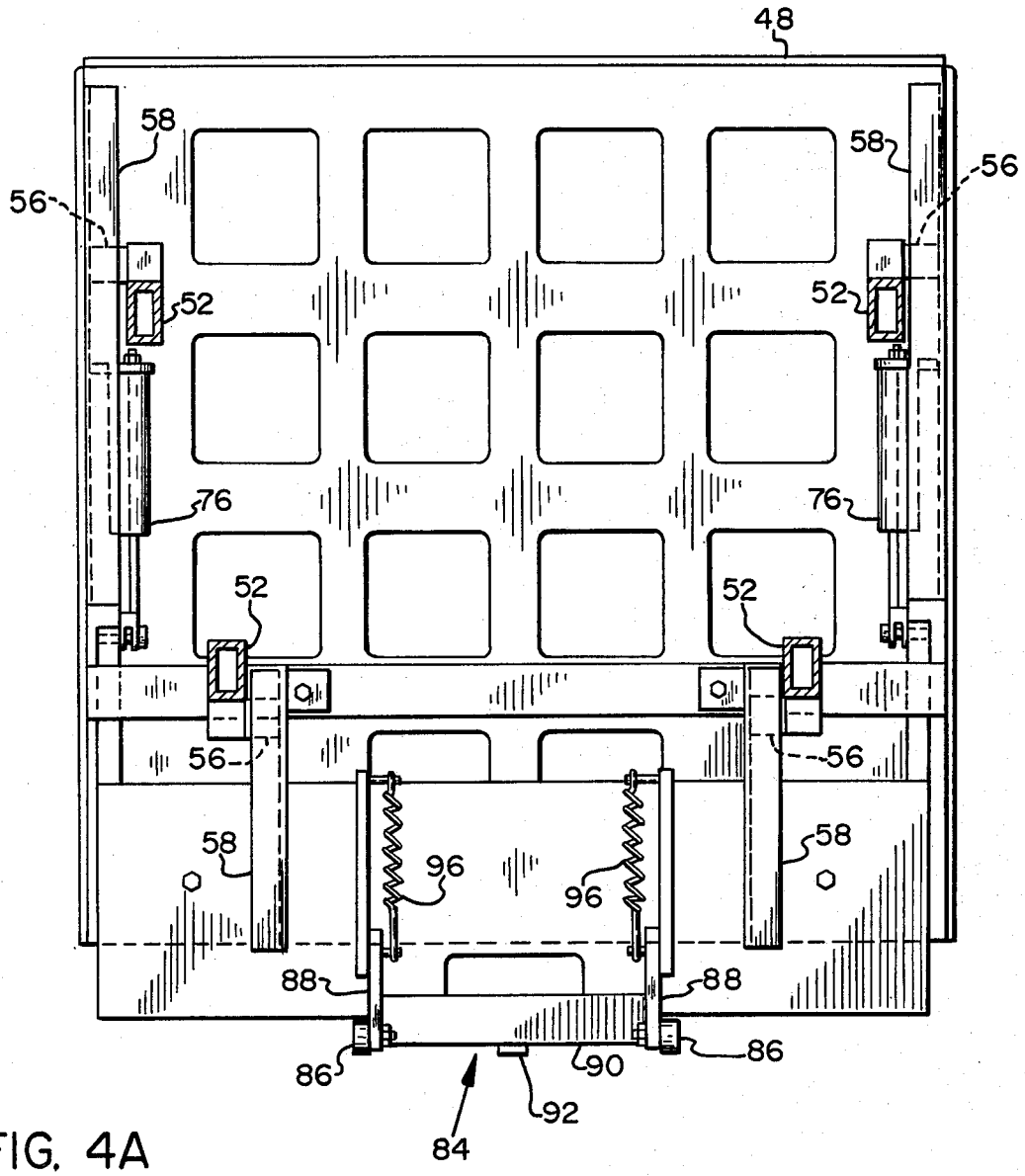
FIG. 4 is a rear view of the push-pull frame taken along line 4—4 of FIG. 1.

During extension and retraction of the push frame 48, the fixed jaw 72 of the slip sheet clamp 50 rides slidably and supportably atop the load-carrying platform 14. However the fact that the platform 14 is rotatable dictates that the push frame 48 must be retractable off of the platform 14 prior to rotation thereof, i.e. retractable into a position such as that depicted in phantom as 48*a* in FIG. 1. This in turn requires that some means other than the platform 14 be provided for vertically supporting the push frame 48 during rotation of the platform 14. One type of construction suitable for satisfying this requirement is a transition support structure which provides substituted vertical support for the push frame when it is retracted rearwardly off of the platform 14, and ensures a smooth transition back to support by the platform when the push frame is thereafter again extended. The transition support structure referred to is indicated generally as 84 in FIG. 1 and is shown in greater detail in FIGS. 4 and 5–9. The structure 84 comprises a pair of transversely-spaced rollers 86 (FIG. 4) rotatably mounted to the bottoms of a pair of struts 88 which are connected together by a crossbar 90 having a depending lug 92. The struts 88 are connected pivotally to the push frame 48 by respective pivot pins 94 and are spring-biased by springs 96 so as to tend to pivot in a counterclockwise direction (as shown in FIGS. 5–9) under the tension of the springs 96. As seen in FIG. 2, a pair of slots 98 and 100 are formed in the upper surface of the tilting frame 16 in longitudinal alignment with the depending lug 92. The front of the slot 98 is substantially aligned transversely with the rear edge of the platform 14 when the platform is in its longitudinal rotatable position as shown in solid lines in FIG. 2, while the front edge of the slot 100 is transversely aligned with the rear edge of the platform 14 when the platform is in its transverse rotatable position as shown in phantom in FIG. 2.

FIGS. 5–9 depict the sequence of operation as the push frame 48 is retracted rearwardly off of the platform 14 while the platform is in its longitudinal rotatable position, preparatory to rotation of the platform to its transverse rotatable position. The push frame 42 is retracted rearwardly with the fixed lower jaw 72 of the slip sheet claim sliding supportably along the top of the platform 14 as shown in FIG. 5. The depending lug 92 simultaneously slides rearwardly also supported by the top of the platform 14, but reaches the rear edge of the platform 14 ahead of the jaw 72, permitting the spring 96 to rotate the struts 88 counterclockwise such that the lug 92 drops into the slot 98 contacting the rear edge thereof as shown in FIG. 6. Further retraction of the push frame 48 causes further counterclockwise rotation of the struts 88 due to the fact that the lug 92 is prevented by the rear edge of the slot 98 temporarily from further rearward movement. This further clockwise rotation of the struts 88 tends to lift the push frame 48 upwardly since the crossbar 90 between the struts is supported by the upper surface of the tilting frame 16. The counterclockwise rotation of the struts 88, and upward motion of the push frame 48 continues until the position of FIG. 7 is reached where the rollers 86 are supported atop the tilting frame 16. Further rearward movement of the push frame 48 results in a fully-retracted position as shown in FIG. 8 wherein the push frame 48 is supported at an elevated position by the rollers 86 and the struts 88 are in an overcenter position abutting the rear of the lower jaw 72. Extension of the push frame 48 from the fully-retracted position is depicted in FIG. 9 where the lug 92 engages the rear edge of the platform 14 thereby causing the struts 88 to rotate clockwise and lower the push frame 48 so that the lower jaw 72 once more comes into supportive abutment with the top of the rotatable platform 14, thereby once more assuming the position depicted in FIG. 5. A similar sequence of operation occurs upon retraction and subsequent extension of the push frame when the platform 14 is rotated to its transverse rotatable position, in which case slot 100 rather than slot 98 is involved in the sequence of operations.

It should be noted that the above-described transition support structure 84 is merely one exemplary structure for providing the substituted support of the push frame 48 upon full retraction of the push frame. Alternative structures might, for example, utilize temporary substituted support provided through the forward couplings 56 of the arms 52 of the push-pull assembly or through the related channels 58.

Figure 4A:
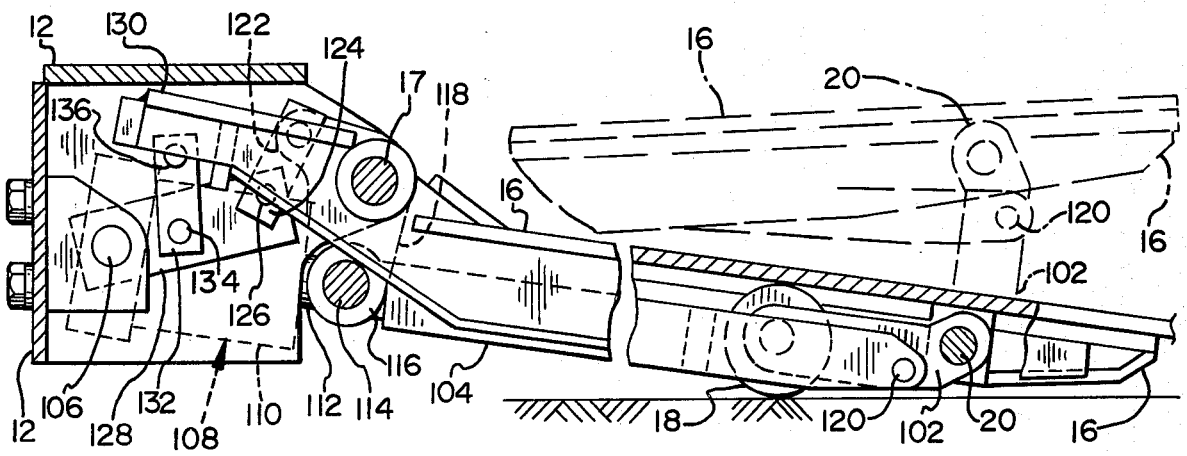
FIG. 4A is a detailed extended sectional view of an exemplary structure for maintaining the main frame of the low-lift truck at a constant attitude with respect to the ground during tilting of the load-carrying platform.

Although the preferable mechanism by which the tilting frame 16 is raised and lowered is not part of the present invention, and is applicable only to a low-lift truck of the type shown in FIG. 1 whereas the present invention is equally applicable to trucks of the high-lift type wherein tilting is accomplished by means of tilting the mast, the preferred structure will be described in this and the following three paragraphs with respect to FIG. **4*a* for purposes of explanation. The front end of the tilting frame 16, which for simplicity is shown in FIG. 4*a* without the rotating load-carrying platform 14 thereon, is supported by laterally-spaced pairs of load-supporting struts 102 (only one of which is shown) pivotally mounted by transverse shafts 20 to the tilting frame 16 and having supporting wheels 18 rotatably mounted to their depending ends. Rigid, transversely-spaced control arms 104 (only one of which is shown) retract rearwardly to rotate the struts 102 rearwardly in unison to move the load-supporting wheels 18 toward the main frame 12. Rearward rotation of the struts, depending upon the degree of rotation, lowers the tilting frame 16 to various depressed positions. Conversely, forward extension of the control arms 104 results in forward rotation of the struts, raising the tilting frame 16 to a maximum raised position wherein the frame 16 is at least substantially horizontal and preferably tilts rearwardly toward the main frame 12 as illustrated in phantom in FIG. 4*a***.

A pair of laterally-spaced identical crank and lever assemblies, only one of which is illustrated in FIG. **4*a*, maintain the angular attitude of the main frame 12 constant with respect to the ground as the tilting frame 16 moves tiltably between its lowered and raised positions. Fixedly attached to the main frame 12 are mounting bracket and pivot shaft assemblies such as 106 which pivotally mount a hydraulic ram 108 having a cylinder portion 110 and an extensible piston rod 112 extending forwardly from the cylinder portion 110. A cross shaft 114 extends transversely from the end of the piston rod 112 and pivotally interconnects with the rear ends of the control arms 104 and also through the lower arm 116 of a respective crank 118, the crank being mounted rotatably to the main frame 12 on the shaft 17**.

As the piston rod 112 is retracted to the position illustrated in FIG. **4*a*, two actions simultaneously and coordinately occur. First, the cross shaft 114 is pulled rearwardly and the cross shaft in turn pulls the control arms 104 rearward. The control arms 104 are connected to the struts 102 pivotally by means of a respective shaft 120. Therefore, when the ram 108 pulls the control arms 104 rearward, the struts 102 rotate from a generally vertical position, wherein the tilting frame 16 is in its raised position, to a folded position wherein the frame 16** is in its lowered position.

Second, as the piston rod 112 is retracted the cross shaft 114 pulls rearward upon the lower arm 116 of the respective crank 118, causing the crank to rotate about the shaft 17. This rotation, clockwise as seen in FIG. **4*a*, causes the upper arm 122 of the crank 118 to move upward. The upper crank arm 122 is connected pivotally to a forward connecting link 124 which depends from the upper arm 122 and is pivotally connected at its lower end to an outer pivot joint 126 on an elongated idler lever 128. The idler lever 128 extends rearwardly to a pivotal interconnection with the main frame 12 by means of a respective pivot shaft 106, and thus pivots upward about the shaft 106 in unison with the clockwise rotation of the respective crank 118. A rearward extension portion 130 of the tilting frame 16, extending toward the main frame beyond the respective shaft 17, connects pivotally to the idler lever 128** by means of a rear connecting link 132 connecting an inner pivot joint 134 of the idler lever with a pivot joint 136 of the rearward extension portion 130. Thus as the idler lever 128 pivots upward about the shaft 106 in response to the clockwise rotation of the crank 118 the idler lever forcibly causes relative pivoting between the tilting frame 16 and the main frame 12 in a direction tending to tilt the tilting frame downward with respect to the main frame. Conversely, extension of the piston rod 112 returns the tilting frame 16 to its raised position by a reversal of the actions described in the previous two paragraphs.

OPERATION

The operation of the present invention will now be described with reference primarily to the hydraulic circuit diagram of FIG. 10 and the electric circuit diagram of FIG. 11. With reference to FIG. 10, the hydraulic circuit of the lift truck which operates the various hydraulic rams discussed previously comprises a hydraulic pump 138 driven by an electric motor 140 which draws hydraulic fluid from a sump 142 through a filter 144 and supplies the fluid under pressure through a line 146 to a valve assembly 148. Fluid from the various double-acting rams is returned to the sump through the valve assembly 148 and sump return line 150. A pressure relief valve 152 limits the pressure of fluid in the system.

The valve assembly 148 includes three separately-actuatable solenoid hydraulic valves 154, 156 and 158 respectively. Valve 154 controls the extension or retraction of the ram 108 which tilts the load-carrying platform 14. Valve 156 controls the extension and retraction of ram 66 which in turn controls the extension and retraction of the push-pull assembly 46, and also controls the actuation of the slip sheet clamp ram assemblies 76 through automatically-responsive circuitry to be described hereafter. Valve 158 controls the extension or retraction of ram 30 and thereby the rotation of the load-carrying platform 14.

The operation of the system without regard to the actuation of the rotation control valve 158 will first be described. Extension or retraction of the ram 108 which controls tilting is accomplished by movement of electric switch 160 (FIG. 11) to one of its two positions so as to complete the circuit through the respective corresponding solenoid actuator of valve 154, i.e. through one of electrical conductors 162 or 164 and positive ground line 166. At the same time that one of the solenoids of valve 154 is actuated, a motor control solenoid 168 is also actuated by completion of a circuit through one of lines 170 or 172 so as to simultaneously actuate the electric motor 140 and hydraulic pump 138. If desired, a limit switch such as 174 can be provided in either or both of lines 170, 172 responsive to the position of the frame 16 for limiting the maximum movement thereof in either or both directions by automatically deactivating the solenoid switch 168 and thus the motor 140 when an extreme position of the frame 16 is reached.

Actuation of the ram assembly 66 which operates the push-pull mechanism 46 is by means of a switch 176 and corresponding hydraulic valve 156. Retraction of the ram 66 requires movement of the switch 176 so as to complete a circuit through line 178 which shifts valve 156 to the left as seen in FIG. 10. Simultaneously, actuation of the solenoid 168 and motor 140 is accomplished by completion of a circuit through line 180. (It will be noticed that the various diodes in the motor actuation circuit prevent inadvertent actuation of the solenoids of the other hydraulic valves.) Upon actuation of the valve 156 and motor 140 to retract the ram 66, fluid under pressure is supplied through fluid conduit 182 (FIG. 10) to a fluid junction 184 from which fluid under pressure is supplied through a valve 186 (shown in its normal position when the rotator ram 30 is not actuated) and through a conduit 188 to the hydraulic rams 76 of the slip sheet clamp so as to extend the rams and move the clamp to its clamped position. This action would normally occur, for example, when the push frame 48 is in the extended position illustrated in FIG. 1 with the edge 78 of a slip sheet 80 positioned between the lower jaw 72 and upper jaw 74 of the slip sheet clamp so that, upon actuating the push-pull assembly so as to retract it, the slip sheet clamp first clamps tightly onto the slip sheet edge 78 automatically in response to the actuation of the retraction function. Simultaneously with the supply of pressurized fluid from junction 184 to the slip sheet clamp rams 76, pressure is exerted through restricted pilot line 190 upon shuttle valve 192 to move it downward (with a delayed action due to the restriction) to the position shown in FIG. 10 so that the fluid under pressure can be supplied from the junction 184 through the valve 192 and through conduit 194 to the ram 66 so as to retract it after clamping of the slip sheet clamp. This pulls the load 82 onto the load-carrying platform 14. In the absence of actuation of the rotator ram 30 such retraction of the push frame 48 is automatically halted, prior to the push frame being retracted rearwardly off of the platform 14, by a limit switch 196 (FIG. 11) responsive to the position of the push frame which interrupts the actuation circuit for solenoid 168 and motor 140 prior to the retraction of the push frame rearwardly off of the platform 14, thereby interrupting the supply of fluid under pressure to the ram 66.

Extension of the push frame 48, so as to push the load forwardly off of the platform 14, is accomplished by actuation of the switch 176 to its other position so as to complete circuits through lines 198 and 200 thereby moving valve 156 to the right as shown in FIG. 10 and supplying fluid under pressure through conduit 202 to fluid junction 204. From junction 204 fluid under pressure is supplied through conduit 206 to retract rams 76 and thereby release the slip sheet clamp. Simultaneously, pressure through restricted pilot line 208 is applied (again with a delayed action due to the restriction) to shift shuttle valve 192 upwardly and permit the supply of fluid under pressure through conduit 210 to extend ram 66 and thereby the push frame 48. Pressure buildup in conduit 210 unseats pilot-operated check valve 212 to permit the exhaust of fluid from the piston rod side of the ram 66, such fluid being exhausted through conduit 182.

The operation of the slip sheet clamp and push-pull assembly has been described with respect to actuation thereof in the absence of actuation of the rotator ram 30. The following discussion deals with actuation of the ram 30 to rotate the load-carrying platform 14, in coordination with the associated automatic functions of the push-pull assembly and slip sheet clamp in response to the actuation of the rotator ram 30. Extension or retraction of the ram 30 is controlled through hydraulic solenoid valve 158 which is in turn controlled by electric switch 214. Rotation of the platform 14 is accomplished by actuation of the switch 214 to one of its two positions which in turn completes a circuit through one of lines 216 or 218 to partially complete a circuit through a respective one of the solenoids of valve 158 so as to extend or retract the ram 30 as desired. Simultaneously solenoid 168 and motor 140 are actuated through one of lines 220 or 222. However actual extension or retraction of the rotator ram 30 is prevented temporarily, even though the rotator switch 214 has been actuated, by the fact that switch 224 (FIG. 11) prevents completion of a circuit through either of the solenoids of valve 158. Switch 224 is responsive to the retractable position of the push frame 48 and remains in the position shown in FIG. 11 unless the push frame has been retracted rearwardly off of the load-carrying platform 14. Thus the platform 14 cannot be rotated in either direction unless the push frame is retracted rearwardly off of the platform. Such retraction is accomplished automatically in response to the actuation of switch 214 by completion of a circuit through one of lines 226, 228 which actuate push-pull control valve 156 so as to retract push-pull ram 66. It will be noted that such retraction will occur even though the push-pull frame 48 is in its partially retracted position as limited by limit switch 196, since actuation of the push-pull assembly through switch 214 rather than switch 176 bypasses limit switch 196. In the absence of rotation, retraction of the push-pull assembly would normally be accompanied by clamping of the slip sheet clamp in accordance with the previous discussion. However, the opposite result is desired preparatory to rotation, i.e. that the slip sheet clamp be released prior to retraction to ensure that it does not impede rotation by continued attachment to a slip sheet. From the previous discussion, actuation of the slip sheet clamp through valve 186 always precedes retraction of the push-pull assembly (and thus would also precede rotation). The requirement that the slip sheet clamp be released rather than clamped prior to retraction of the push-pull assembly preparatory to rotation of platform 14 is accomplished automatically by movement of solenoid valve 186 to the left as shown in FIG. 10 so as to reverse the normal actuation of the rams 76. Such movement of valve 186 takes place automatically in response to actuation of the rotator control switch 214 through completion of a circuit through one of lines 230, 232 (FIG. 11).

Once the slip sheet clamp has been released, and the push frame retracted rearwardly off of the load-carrying platform 14, the switch 224 (FIG. 11) is moved by such retraction of the push frame to its second position whereby actuation of valve 156 is interrupted while switch 224 now completes a circuit through one of the solenoids of valve 158 so as to rotate the platform 14.

Latch 42 (FIGS. 1 and 2) further prevents rotation of the platform 14 until retraction of the push frame 48 rearwardly off of the platform 14, when the platform is in its longitudinal orientation as shown in solid lines in FIG. 2. Unlatching of the latch 42 is accomplished mechanically by abutment of the rear of the push frame 48, when retracted rearwardly off of the platform 14, with an upwardly-projecting lug **42*a* at the rear of the latch 42 which rotates the latch out of the notch 14*e* of the platform 14** and thereby releases the platform for rotation.

APPLICATION

The method of use of the present invention will now be described with respect to FIGS. 12–20. In the depalletizing of a palletized load 82 (for example preparatory to loading a highway trailer), the load supported atop a rigid pallet 234 is first positioned with one of its longer sides adjacent to a generally vertical, laterally-extending conventional backstop 236 as shown in FIG. 13 by a conventional, fork-equipped lift truck 238. The backstop 236 is rigidly affixed to the ground so as to be immovable and has an opening **236*a* best seen in FIG. 12 adjacent its lower edge through which the pallet 234 is insertable beneath the backstop. It will be noted that when the lift truck 238 positions the load with one of its longest sides against the backstop, the elongate pallet 234 is similarly oriented such that the load-supporting slats extend transversely to the backstop 236. After the palletized load has been so positioned and the conventional lift truck 238 has withdrawn, a lift truck 10 utilizing a rotatable platform 14 in accordance with the present invention approaches the opposite longitudinal side of the load as seen in FIG. 14 with the platform 14 in its transverse orientation, i.e. with the longest edge 14*b* of the platform extending parallel to the backstop. As illustrated in FIGS. 12 and 15, the lift truck 10 is then moved forwardly along its direction of travel so as to insert the platform 14 supportively beneath the load 82 and simultaneously push the pallet 234 from beneath the load through the opening 236*a* in a direction parallel to the slats. With the load 82 fully supported upon the platform 14, the lift truck 10 backs away from the backstop 236 as shown in FIG. 16 and rotates the load 90° with respect to the lift truck to the traveling position wherein the longitudinal dimension of the platform 14 extends along the direction of travel of the lift truck 10 as shown in FIG. 17. The lift truck 10 then transports the load to its destination, such as the interior of a highway trailer 240 and deposits the load by pushing the load forwardly of the lift truck onto a waiting slip sheet lying on the floor of the trailer. The rotatability of the platform 14 permits the load to be deposited forwardly of the lift truck either in a longitudinal orientation, as shown in FIG. 18, or in a transverse orientation as dictated by the "pinwheel" arrangement of the loads within the trailer 240**.

The use of the invention in order to palletize an unpalletized load (for example in conjunction with the unloading of a trailer such as 14) would involve generally the opposite sequence from that just described, with no backstop being involved. Thus the lift truck 10 if it were unloading the load 82 in FIG. 18 would approach the unpalletized load 82 with the platform 14 oriented longitudinally along the direction of travel and pull the load 82 onto the platform 14 from the forward end of the lift truck using the slip sheet clamp. Thereafter the truck 10 would back out of the trailer 240 and transport the load to a waiting pallet. If the lift truck 10 were not equipped with the rotating platform 14 of the present invention, the lift truck would be forced to deposit the load 82 onto a pallet 234 by pushing the load transversely to the load-supporting slats of the pallet as shown in FIG. 20 since the longitudinal orientation of the load in the position in which it was picked up would dictate a longitudinal orientation of the longest dimension B of the pallet with respect to the direction of travel of the lift truck. Pushing of the load onto the pallet transversely to the slats is unsatisfactory as indicated in FIG. 20 since the forward edge of the load tends to catch in the gaps between the slats, impeding progress and damaging the load. In contrast, the lift truck 10 equipped with the present invention, after transporting the load from the trailer 240, rotates the platform 14 90° with respect to the lift truck such that the elongate load and platform 14 are transverse to the direction of travel of the lift truck. In this orientation, the lift truck 10 may then push the load 82 forwardly onto a pallet 234 in the direction of extension of the slats, i.e. in the direction of the shorter dimension A of the pallet, as indicated in FIG. 19 thereby causing no such problem.

The terms and expressions which have been employed in the foregoing specification and used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A mobile lift truck for handling unpalletized loads comprising:

(a) a load-carrying platform;

(b) pivotal means rotatably mounting said load-carrying platform upon said lift truck for permitting rotation of said platform with respect to said lift truck about a generally vertical axis of rotation between first and second rotatable positions substantially 90° apart from each other;

(c) a push frame mounted on said lift truck so as to face in a predetermined direction with respect to said lift truck for pushing a load off of said load-carrying platform in said predetermined direction;

(d) retraction means for retracting said push frame off of said load-carrying platform so as to permit rotation of said platform between said first and second rotatable positions without interference with said push frame;

(e) mounting means attaching said push frame to said lift truck for retaining said push frame in said predetermined direction during rotation of said platform between said first and second rotatable positions so as to enable said push frame to push loads off of said platform in said predetermined direction with respect to said lift truck in both of said respective rotatable positions of said platform; and (f) means connected to said load-carrying platform and responsive to the position of said push frame for preventing rotation of said platform unless said push frame is retracted off of said platform.

2. The lift truck of claim 1 wherein said means connected to said load-carrying platform comprises selectively-actuated power means for rotating said platform, further including control means responsive to the position of said push frame for preventing actuation of said power means unless said push frame is retracted off of said platform.

3. The lift truck of claim 2 including means interconnecting said retraction means with said power means for actuating said retraction means automatically in response to the actuation of said power means and thereby retracting said push frame off of said platform prior to the rotation of said platform by said power means.

4. The lift truck of claim 1 wherein said means connected to said load-carrying platform comprises a latch for locking said platform against rotation, said latch having means responsive to the position of said push frame for releasing said latch to permit rotation of said platform upon retraction of said push frame off of said platform.

5. A mobile lift truck for handling unpalletized loads comprising:

(a) a load-carrying platform;

(b) pivotal means rotatably mounting said load-carrying platform upon said lift truck for permitting rotation of said platform with respect to said lift truck about a generally vertical axis of rotation between first and second rotatable positions substantially 90° apart from each other;

(c) a push frame mounted on said lift truck so as to face in a predetermined direction with respect to said lift truck for pushing a load off of said load-carrying platform in said predetermined direction;

(d) mounting means attaching said push frame to said lift truck for retaining said push frame in said predetermined direction during rotation of said platform between said first and second rotatable positions so as to enable said push frame to push loads off of said platform in said predetermined direction with respect to said lift truck in both of said respective rotatable positions of said platform;

(e) said push frame including a slip sheet clamp mounted thereon adapted to be selectively actuated between clamped and released positions; and (f) means responsive to the position of said slip sheet clamp for preventing rotation of said platform unless said slip sheet clamp is in its released position.

6. The lift truck of claim 5 including selectively-actuated power means connected to said load-carrying platform for rotating said platform, further including control means responsive to the position of said slip sheet clamp for preventing actuation of said power means unless said slip sheet clamp is in its released position.

7. The lift truck of claim 6 including means interconnecting said slip sheet clamp with said power means for releasing said slip sheet clamp automatically in response to the actuation of said power means and prior to the rotation of said platform by said power means.

8. A mobile lift truck for handling unpalletized loads comprising:

(a) a main frame adapted to move forwardly in a direction of travel having a longitudinal center-line parallel to said direction of travel;

(b) a load-carrying platform projecting from said main frame;

(c) pivotal means rotatably mounting said load-carrying platform upon said main frame for permitting rotation of said platform with respect to said main frame about a generally vertical axis of rotation between first and second rotatable positions substantially 90° apart from each other;

(d) an upwardly-facing, load-supporting surface on said load-carrying platform extending substantially continuously both in the direction of travel of said main frame and across the longitudinal center-line of said main frame in both said first and second rotatable positions of said platform, said load-supporting surface having a pair of load-engaging edges formed therein extending substantially perpendicularly to each other;

(e) each of said load-engaging edges being beveled for facilitating the sliding of unpalletized loads onto said load-carrying platform.

9. The lift truck of claim 8, further including a push frame for pushing a load off of said load-engaging edges of said platform and mounting means attaching said push frame to said lift truck for retaining said push frame in a predetermined direction during rotation of said platform between said first and second rotatable positions, said push frame including a slip sheet clamp mounted thereon adapted to be selectively actuated between clamped and released positions for pulling unpalletized loads onto said load-carrying platform over said load-engaging edges.

10. A mobile lift truck for handling unpalletized loads comprising:

(a) a main frame;

(b) a load-carrying platform projecting from said main frame;

(c) pivotal means rotatably mounting said load-carrying platform upon said main frame for permitting rotation of said platform with respect to said main frame about a generally vertical axis of rotation between first and second rotatable positions substantially 90° apart from each other;

(d) a push frame for pushing a load off of said load-carrying platform;

(e) retraction means for retracting said push frame off of said load-carrying platform to permit rotation of said platform about said vertical axis without interference with said push frame; and (f) means connected to said load-carrying platform and responsive to the position of said push frame for preventing rotation of said platform unless said push frame is retracted off of said platform.

11. The lift truck of claim 10 wherein said means connected to said load-carrying platform comprises selectively-actuated power means for rotating said platform, further including control means responsive to the position of said push frame for preventing actuation of said power means unless said push frame is retracted off of said platform.

12. The lift truck of claim 11 including means interconnecting said retraction means with said power means for actuating said retraction means automatically in response to the actuation of said power means and thereby retracting said push frame off of said platform prior to the rotation of said platform by said power means.

13. A mobile lift truck for handling unpalletized loads comprising:

(a) a main frame;

(b) a load-carrying platform projecting from said main frame;

(c) pivotal means rotatably mounting said load-carrying platform upon said main frame for permitting rotation of said platform with respect to said main frame about a generally vertical axis of rotation between first and second rotatable positions substantially 90° apart from each other;

(d) a push frame for pushing a load off of said load-carrying platform;

(e) a slip sheet clamp mounted upon said push frame adapted to be selectively actuated between clamped and released positions; and (f) means responsive to the position of said slip sheet clamp for preventing rotation of said platform unless said slip sheet clamp is in its released position.

14. The lift truck of claim 13 including selectively-actuated power means connected to said load-carrying platform for rotating said platform, further including control means responsive to the position of said slip sheet clamp for preventing actuation of said power means unless said slip sheet clamp is in its released position.

15. The lift truck of claim 14 including means interconnecting said slip sheet clamp with said power means for releasing said slip sheet clamp automatically in response to the actuation of said power means and prior to the rotation of said platform by said power means.

16. A method of depalletizing a palletized load, said method comprising:

(a) positioning one side of said load, while said load is supported atop a pallet, adjacent to a generally vertical, laterally-extending backstop having an opening adjacent its lower edge through which said pallet is insertable beneath said backstop;

(b) approaching the opposite side of said load with a lift truck having a load-carrying platform thereon which is pivotal with respect to said lift truck about a generally vertical axis of rotation between respective rotatable positions substantially 90° apart from each other;

(c) while said load-carrying platform is in one of said rotatable positions, inserting said platform supportively beneath said load and sliding said pallet from beneath said load through said opening at the bottom of said backstop by moving said platform toward said backstop along a predetermined direction with respect to said lift truck;

(d) rotating said load-carrying platform 90° with respect to said lift truck to the other of said rotatable positions while said load is supported upon said platform; and (e) while said platform remains in the last-mentioned rotatable position, depositing said load from said platform in said predetermined direction with respect to said lift truck.

17. the method of claim 16 wherein said load-carrying platform is of elongate shape, said step (c) including inserting said load-carrying platform beneath said load with the longitudinal dimension of said platform extending transversely to said predetermined direction, and said step (e) comprising depositing said load from said platform with the longitudinal dimension of said platform extending parallel to said predetermined direction.

18. A method of palletizing an unpalletized load, said method comprising:

(a) approaching said unpalletized load with a lift truck having a load-carrying platform thereon which is pivotal with respect to said lift truck about a generally vertical axis of rotation between respective positions substantially 90° apart from each other;

(b) while said load-carrying platform is in one of said rotatable positions, pulling said load onto said load-carrying platform from a predetermined direction with respect to said lift truck;

(c) rotating said load-carrying platform 90° with respect to said lift truck to the other of said rotatable positions while said load is supported upon said platform; and (d) while said platform remains in the last-mentioned rotatable position, depositing said load from said platform onto a pallet in said predetermined direction with respect to said lift truck.

19. The method of claim 18 wherein said load-carrying platform is of elongate shape, sai step (b) comprising pulling said load onto said platform with the longitudinal dimension of said platform extending parallel to said predetermined direction, and said step (d) comprising depositing said load from said platform onto said pallet with the longitudinal dimension of said platform extending transversely to said predetermined direction.

20. A mobile lift truck for handling unpalletized loads comprising:

(a) a load-carrying platform;
(b) pivotal means rotatably mounting said load-carrying platform upon said lift truck for permitting rotation of said platform with respect to said lift truck about a generally vertical axis of rotation between first and second rotatable positions substantially 90° apart from each other;
(c) a push frame mounted on said lift truck so as to face in a predetermined direction with respect to said lift truck for pushing a load off of said load-carrying platform in said predetermined direction, said push frame including engagement means at the bottom thereof for engaging said load-carrying platform and thereby vertically supporting said push frame upon said platform;
(d) retraction means for retracting said push frame off of said load-carrying platform so as to permit rotation of said platform between said first and second rotatable positions without interference with said push frame;
(e) mounting means attaching said push frame to said lift truck for retaining said push frame in said predetermined direction during rotation of said platform between said first and second rotatable positions so as to enable said push frame to push loads off of said platform in said predetermined direction with respect to said lift truck in both of the respective rotatable positions of said platform;
(f) means for permitting vertical movement of said push frame relative to said mounting means; and
(g) means for vertically supporting said push frame when said push frame is retracted off of said platform.

21. A mobile lift truck for handling unpalletized loads comprising:
(a) a main frame adapted to move forwardly in a direction of travel having a longitudinal centerline parallel to said direction of travel;
(b) a load-carrying platform projecting from said main frame;
(c) pivotal means rotatably mounting said load-carrying platform upon said main frame for permitting rotation of said platform with respect to said main frame about a generally vertical axis of rotation between first and second rotatable positions substantially 90° apart from each other;
(d) an upwardly-facing, load-supporting surface on said load-carrying platform extending substantially continuously both in the direction of travel of said main frame and across the longitudinal centerline of said main frame in both said first and second rotatable positions of said platform, said load-supporting surface having a pair of load-engaging edges formed therein extending substantially perpendicularly to each other;
(e) said vertical axis of rotation of said pivotal means being located within, but offset from the center of, the area of said load-supporting surface and being transversely offset from said longitudinal centerline of said main frame.

22. A mobile lift truck for handling unpalletized loads comprising:
(a) a main frame adapted to move forwardly in a direction of travel having a longitudinal centerline parallel to said direction of travel;
(b) a load-carrying platform projecting from said main frame;
(c) pivotal means rotatably mounting said load-carrying platform upon said main frame, said pivotal means being located below said load-carrying platform, for permitting rotation of said platform with respect to said main frame about a generally vertical axis of rotation between first and second rotatable positions substantially 90° apart from each other;
(d) an upwardly-facing load-supporting surface on said load-carrying platform having a pair of load-engaging edges formed therein extending substantially perpendicular to each other;
(e) said vertical axis of rotation of said pivotal means being located within, but offset from the center of, the area of said load-supporting surface and being transversely offset from said longitudinal centerline of said main frame.

23. A mobile lift truck for handling unpalletized loads comprising:
(a) a main frame adapted to move forwardly in a direction of travel having a longitudinal centerline parallel to said direction of travel;
(b) a load-carrying platform projecting from said main frame;
(c) pivotal means rotatably mounting said load-carrying platform upon said main frame, said pivotal means being located below said load-carrying platform, for permitting rotation of said platform with respect to said main frame about a generally vertical axis of rotation between first and second rotatable positions substantially 90° apart from each other;
(d) an upwardly-facing load-supporting surface on said load-carrying platform having a pair of load-engaging edges formed therein extending substantially perpendicularly to each other;
(e) said vertical axis of rotation of said pivotal means being located within, but offset from the center of, the area of said load-supporting surface;
(f) one of said load-engaging edges of said load-supporting surface being longer than the other, and said vertical axis of rotation of said pivotal means being located between the center of the area of said load-supporting surface and the longer of said edges.

* * * * *